US011150580B2

(12) United States Patent
Watanabe

(10) Patent No.: US 11,150,580 B2
(45) Date of Patent: Oct. 19, 2021

(54) PRESSURE DEVICE, FIXING DEVICE, AND IMAGE FORMING APPARATUS

(71) Applicant: Ricoh Company, Ltd., Tokyo (JP)

(72) Inventor: Yohhei Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/916,350

(22) Filed: Jun. 30, 2020

(65) Prior Publication Data

US 2021/0041813 A1 Feb. 11, 2021

(30) Foreign Application Priority Data

Aug. 9, 2019 (JP) ..... JP2019-147403

(51) Int. Cl.
*G03G 15/20* (2006.01)

(52) U.S. Cl.
CPC ..... *G03G 15/2028* (2013.01); *G03G 15/2053* (2013.01); *G03G 15/2092* (2013.01)

(58) Field of Classification Search
None
See application file for complete search history.

(56) References Cited

U.S. PATENT DOCUMENTS 5,630,199 A * 5/1997 To ..... G03G 15/0216 399/175
5,799,229 A * 8/1998 Yokoyama ..... G03G 15/0225 399/100
5,852,758 A * 12/1998 Wibbels ..... G03G 15/0216 399/176
7,062,194 B2 * 6/2006 Yanagida ..... G03G 15/0225 399/100
7,283,767 B1 * 10/2007 Hagimoto ..... G03G 21/0047 399/149
7,734,212 B2 * 6/2010 Miyaji ..... G03G 15/0225 399/100
8,081,889 B2 * 12/2011 Kim ..... G03G 21/0058 399/34
2006/0269322 A1 * 11/2006 Tanaka ..... G03G 21/08 399/128
2009/0123203 A1 * 5/2009 Tanaka ..... G03G 15/2053 399/330
2009/0245898 A1 * 10/2009 Gon ..... G03G 15/2042 399/328
2010/0040386 A1 2/2010 Mizutani et al.
2012/0148300 A1 6/2012 Katoh et al.
2014/0212188 A1 7/2014 Watanabe
2015/0323892 A1 11/2015 Sakamaki et al.
2016/0124357 A1 5/2016 Ujiie et al.
(Continued)

FOREIGN PATENT DOCUMENTS

JP 2017-167381 9/2017
JP 2017-21 9674 12/2017
JP 2018-087892 6/2018

*Primary Examiner* — Sevan A Aydin
(74) *Attorney, Agent, or Firm* — Xsensus LLP

(57) ABSTRACT

A pressure device presses against a pressed member. The pressure device includes a support shaft and a presser that pivots about the support shaft and presses against the pressed member. A mover moves the support shaft in an axial direction of the support shaft to move the presser in the axial direction of the support shaft in a state in which the presser presses against the pressed member.

20 Claims, 4 Drawing Sheets

(56) References Cited

U.S. PATENT DOCUMENTS

| | | | | |
|---|---|---|---|---|
| 2016/0124361 | A1 | 5/2016 | Watanabe et al. | |
| 2016/0202646 | A1 | 7/2016 | Suzuki et al. | |
| 2016/0363898 | A1* | 12/2016 | Ujiie | G03G 15/2025 |
| 2017/0090368 | A1* | 3/2017 | Ujiie | G03G 15/2025 |
| 2017/0235259 | A1 | 8/2017 | Saitoh et al. | |
| 2017/0357198 | A1 | 12/2017 | Namekata et al. | |
| 2018/0088502 | A1 | 3/2018 | Sugiyama et al. | |
| 2018/0275554 | A1* | 9/2018 | Yamazaki | G03G 15/0225 |
| 2019/0011864 | A1 | 1/2019 | Kawata et al. | |
| 2019/0018348 | A1 | 1/2019 | Watanabe et al. | |
| 2019/0018351 | A1 | 1/2019 | Hirose et al. | |

* cited by examiner

PRESSURE DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-147403, filed on Aug. 9, 2019, in the Japan Patent Office, the entire disclosure of which is hereby incorporated by reference herein.

BACKGROUND

Technical Field

Exemplary aspects of the present disclosure relate to a pressure device, a fixing device, and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a pressure device that presses a presser against a pressed member.

SUMMARY

This specification describes below an improved pressure device. In one embodiment, the pressure device presses against a pressed member and includes a support shaft and a presser that pivots about the support shaft and presses against the pressed member. The pressure device further includes a mover that moves the support shaft in an axial direction of the support shaft to move the presser in the axial direction of the support shaft in a state in which the presser presses against the pressed member.

This specification further describes below an improved fixing device. In one embodiment, the fixing device includes a fixing rotator and a pressure rotator that presses against the fixing rotator to form a fixing nip between the fixing rotator and the pressure rotator, through which a recording medium bearing an unfixed image is conveyed. The fixing device further includes a pressure device that presses against the fixing rotator. The pressure device includes a support shaft and a presser that pivots about the support shaft and presses against the fixing rotator. The pressure device further includes a mover that moves the support shaft in an axial direction of the support shaft to move the presser in the axial direction of the support shaft in a state in which the presser presses against the fixing rotator.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
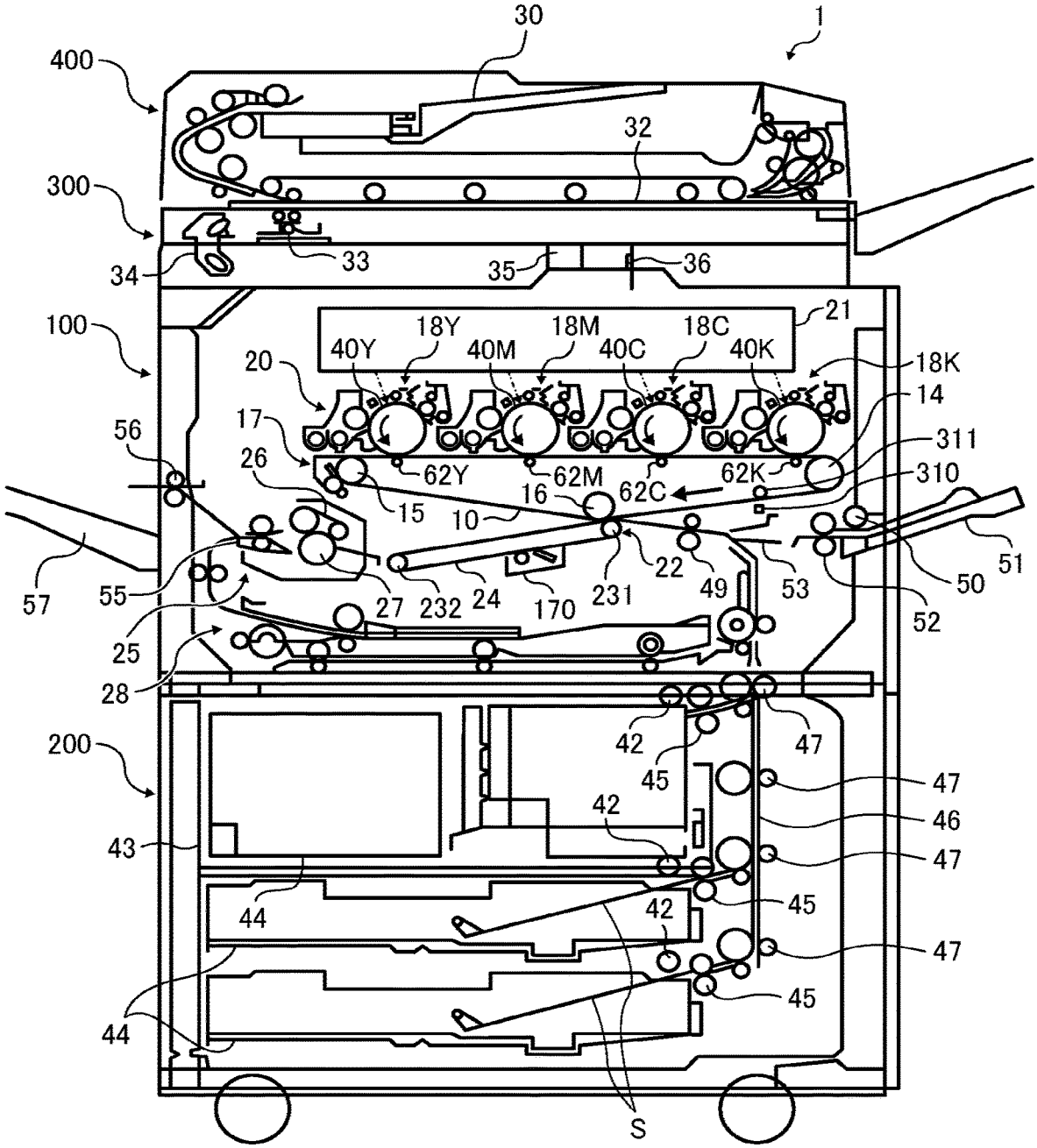
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of embodiments of the present disclosure.

FIG. 1 is a schematic cross-sectional view of an image forming apparatus 1 according to an embodiment of the present disclosure, illustrating one example of a construction of the image forming apparatus 1.

As illustrated in FIG. 1, the image forming apparatus 1 according to this embodiment includes an apparatus body 100, a sheet feeding table 200, and a scanner 300. The apparatus body 100 is a printer section. The sheet feeding table 200 serves as a recording medium supply that mounts the apparatus body 100. The scanner 300 serves as an image reading device mounted on the apparatus body 100. The image forming apparatus 1 according to this embodiment further includes an auto document feeder (ADF) 400 mounted on the scanner 300.

An intermediate transfer belt 10 is disposed in a center of the apparatus body 100. The intermediate transfer belt 10 serves as an intermediate transferor, that is, an endless belt serving as an image bearer. The intermediate transfer belt 10 is looped over three supporting rotators, that is, a first support roller 14, a second support roller 15, and a third support roller 16, and rotates clockwise in FIG. 1. An intermediate transfer belt cleaner 17 is disposed on the left of one of the three supporting rotators, that is, the second support roller 15, in FIG. 1. The intermediate transfer belt cleaner 17 removes residual toner remained on the intermediate transfer belt 10 after a toner image is transferred from the intermediate transfer belt 10. The intermediate transfer belt 10 includes a belt portion that is stretched and interposed between two of the three supporting rotators, that is, the first support roller 14 and the second support roller 15. A tandem image former 20 serving as an image former is disposed opposite the belt portion of the intermediate transfer belt 10.

As illustrated in FIG. 1, the tandem image former 20 includes four image forming devices 18Y, 18M, 18C, and 18K disposed opposite the belt portion of the intermediate transfer belt 10 and arranged in a rotation direction of the intermediate transfer belt 10. The image forming devices 18Y, 18M, 18C, and 18K form toner images in yellow (Y), magenta (M), cyan (C), and black (K), respectively. According to this embodiment, the third support roller 16 serves as a driving roller. An exposure device 21 is disposed above the tandem image former 20.

A secondary transfer device 22 serving as a secondary transferor is disposed opposite the tandem image former 20 via the intermediate transfer belt 10. The secondary transfer device 22 includes two rollers 231 and 232 and a secondary transfer belt 24 looped over the rollers 231 and 232. The secondary transfer belt 24 is an endless belt serving as a transfer sheet conveyer. The secondary transfer belt 24 is pressed against the third support roller 16 via the intermediate transfer belt 10. The secondary transfer device 22 transfers a toner image formed on the intermediate transfer belt 10 onto a transfer sheet S serving as a recording medium. Optionally, as illustrated in FIG. 1, the image forming apparatus 1 may include a cleaner 170 that cleans an outer circumferential surface of the secondary transfer belt 24.

A fixing device 25 is disposed on the left of the secondary transfer device 22 in FIG. 1. The fixing device 25 fixes the toner image transferred onto the transfer sheet S thereon. The fixing device 25 includes a fixing belt 26 and a pressure roller 27. The fixing belt 26 serving as a fixing rotator or a fixing member is an endless belt that is heated. The pressure roller 27 serving as a pressure rotator or a pressure member is pressed against the fixing belt 26.

The secondary transfer device 22 also serves as a sheet conveyer that conveys the transfer sheet S to the fixing device 25 after the toner image formed on the intermediate transfer belt 10 is transferred onto the transfer sheet S. A sheet reversing device 28 is disposed below the secondary transfer device 22 and the fixing device 25 in FIG. 1 and is parallel to the tandem image former 20. The sheet reversing device 28 reverses the transfer sheet S for duplex printing to form toner images on both sides of the transfer sheet S, respectively.

A description is provided of copying operations performed by the image forming apparatus 1 having the construction described above.

A user places an original on an original tray 30 of the auto document feeder 400. Alternatively, the user lifts the auto document feeder 400, places an original on an exposure glass 32 of the scanner 300, and lowers the auto document feeder 400 so that the auto document feeder 400 presses the original against the exposure glass 32. Thereafter, the user presses a start key on a control panel. If the user places the original on the auto document feeder 400, when the user presses the start key, the auto document feeder 400 feeds and moves the original onto the exposure glass 32.

Conversely, if the user places the original on the exposure glass 32, when the user presses the start key, the scanner 300 is driven immediately so that a first carrier 33 and a second carrier 34 of the scanner 300 move. A light source of the first carrier 33 emits light. The light is reflected by a face of the original toward the second carrier 34. A mirror of the second carrier 34 reflects the light toward an image reading sensor 36 through an image forming lens 35 so that the image reading sensor 36 reads an image on the original into image data.

While the scanner 300 reads the image on the original, a driving motor serving as a driver drives and rotates the third support roller 16 serving as a driving roller. Accordingly, while the intermediate transfer belt 10 rotates clockwise in FIG. 1, the remaining two supporting rotators serving as driven rollers, that is, the first support roller 14 and the second support roller 15, rotate in accordance with rotation of the intermediate transfer belt 10.

While the scanner 300 reads the image on the original and the intermediate transfer belt 10 rotates, drum-shaped photoconductors 40Y, 40M, 40C, and 40K serving as image bearers of the image forming devices 18Y, 18M, 18C, and 18K, respectively, rotate. Exposure and developing are performed on the photoconductors 40Y, 40M, 40C, and 40K according to image data of yellow, magenta, cyan, and black, visualizing electrostatic latent images formed on the photoconductors 40Y, 40M, 40C, and 40K into yellow, magenta, cyan, and black toner images, respectively.

Primary transfer devices 62Y, 62M, 62C, and 62K are disposed opposite the photoconductors 40Y, 40M, 40C, and 40K via the belt portion of the intermediate transfer belt 10, that is interposed between the first support roller 14 and the second support roller 15. The primary transfer devices 62Y, 62M, 62C, and 62K include primary transfer rollers serving as primary transferors, respectively. The primary transfer devices 62Y, 62M, 62C, and 62K successively transfer the yellow, magenta, cyan, and black toner images formed on the photoconductors 40Y, 40M, 40C, and 40K, respectively, such that the yellow, magenta, cyan, and black toner images are superimposed on the intermediate transfer belt 10, thus forming a composite color toner image on the intermediate transfer belt 10.

While the composite color toner image is formed as described above, one of sheet feeding rollers 42 of the sheet feeding table 200 is rotated selectively to pick up and feed a transfer sheet S from one of sheet trays 44 (e.g., paper trays) placed in a multistage inside a paper bank 43. A separating roller 45 separates the transfer sheet S that is picked up from other transfer sheets S and feeds the transfer sheet S to a sheet feeding path 46. Conveying rollers 47 convey the transfer sheet S to a sheet feeding path inside the apparatus body 100. As the transfer sheet S strikes the registration roller 49, the registration roller 49 halts the transfer sheet S. Alternatively, a sheet feeding roller 50 rotates to pick up and feed a transfer sheet S placed on a bypass tray 51. A separating roller 52 separates the transfer sheet S that is picked up from other transfer sheets S and feeds the transfer sheet S to a bypass sheet feeding path 53. As the transfer sheet S strikes the registration roller 49, the registration roller 49 halts the transfer sheet S.

Subsequently, the registration roller 49 rotates to correspond to formation of the composite color toner image on the intermediate transfer belt 10. The registration roller 49 conveys the transfer sheet S to a nip formed between the intermediate transfer belt 10 and the secondary transfer device 22. The secondary transfer device 22 transfers the composite color toner image formed on the intermediate transfer belt 10 onto the transfer sheet S.

The secondary transfer belt 24 conveys the transfer sheet S transferred with the composite color toner image to the fixing device 25. The fixing belt 26 and the pressure roller 27 of the fixing device 25 fix the composite color toner image on the transfer sheet S under heat and pressure. Thereafter, a switching pawl 55 switches a conveyance direction of the transfer sheet S toward an ejection roller 56 that ejects and stacks the transfer sheet S onto a sheet ejection tray 57. Alternatively, the switching pawl 55 switches the conveyance direction of the transfer sheet S toward the sheet reversing device 28 that reverses and guides the transfer sheet S to the secondary transfer device 22. The secondary transfer device 22 transfers another composite color toner image onto a back side of the transfer sheet S. Thereafter, the ejection roller 56 ejects the transfer sheet S onto the sheet ejection tray 57.

After the composite color toner image is transferred from the intermediate transfer belt 10 onto the transfer sheet S, the intermediate transfer belt cleaner 17 removes residual toner remaining on the intermediate transfer belt 10 therefrom. Thus, the intermediate transfer belt 10 is ready for a next image forming job performed by the tandem image former 20. The registration roller 49 is generally grounded. Alternatively, the registration roller 49 may be applied with a bias to remove paper dust generated from the transfer sheet S.

The apparatus body 100 further includes a toner adhesion sensor 310 serving as an image density detector that detects the density of toner of a toner image (e.g., a composite color toner image) formed on an outer circumferential surface of the intermediate transfer belt 10. The toner adhesion sensor 310 is an optical sensor unit including an optical sensor. The toner adhesion sensor 310 serves as the image density detector that detects the density of toner of the toner image formed on the intermediate transfer belt 10 so as to detect unevenness of the density of toner of the toner image by detecting an amount of toner adhered on the intermediate transfer belt 10. The toner adhesion sensor 310 is called a toner image detecting sensor or a toner adhesion amount detecting sensor. The toner adhesion sensor 310 detects the density of toner of a toner image formed on a test pattern for a correction control described below. The test pattern is formed on the outer circumferential surface of the intermediate transfer belt 10 and is used for the correction control to correct unevenness of the density of toner of the toner image. Optionally, as illustrated in FIG. 1, an opposed roller 311 may be disposed opposite the toner adhesion sensor 310 via the intermediate transfer belt 10.

Figure 2:
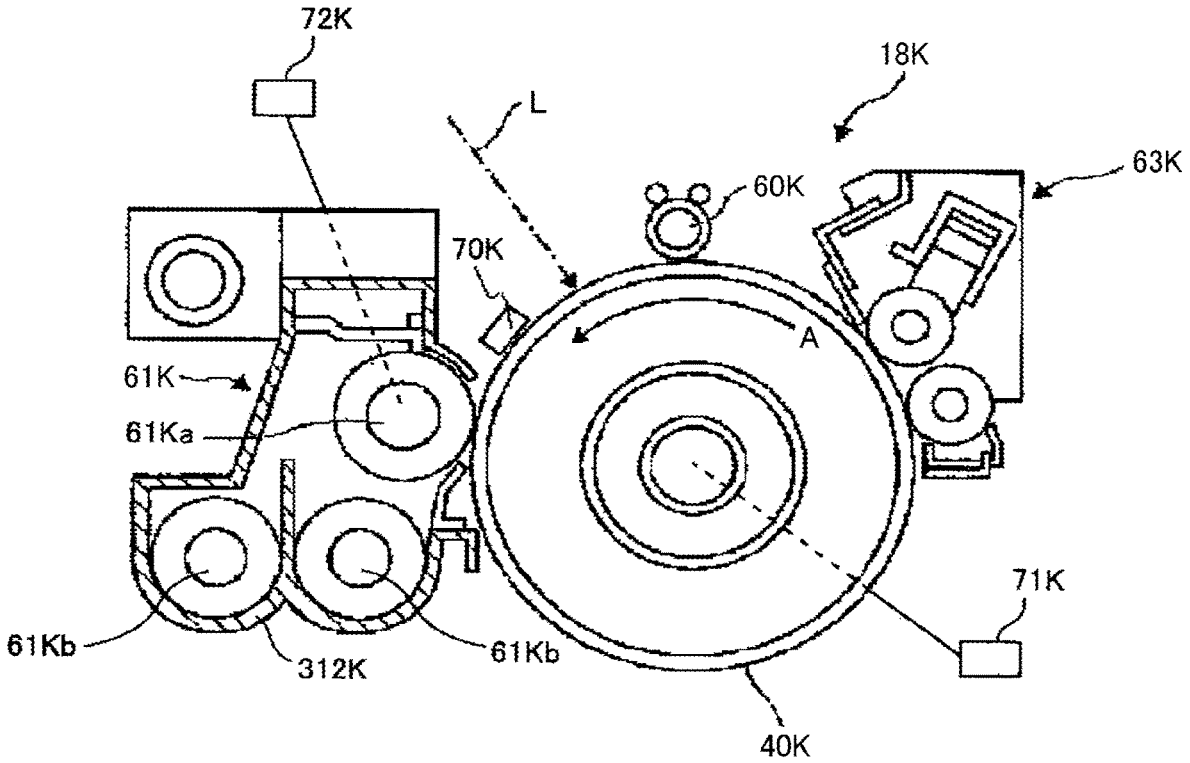
FIG. 2 is a cross-sectional view of an image forming device of a tandem image former incorporated in the image forming apparatus depicted in FIG. 1, illustrating one example of a construction of the image forming device.

FIG. 2 is a cross-sectional view of the image forming device 18K of the tandem image former 20 of the image forming apparatus 1 according to an embodiment of the present disclosure, illustrating one example of a construction of the image forming device 18K.

Although the following describes the construction of the image forming device 18K that forms a black toner image, each of the image forming devices 18Y, 18M, and 18C that form yellow, magenta, and cyan toner images, respectively, has a construction similar to the construction of the image forming device 18K.

For example, as illustrated in FIG. 2, the image forming device 18K includes a charging device 60K serving as a charger, an electric potential sensor 70K, a developing device 61K serving as developing means, a photoconductor cleaner 63K, and a discharger, which surround the drum-shaped photoconductor 40K.

While the image forming device 18K performs image formation, a driving motor serving as an image bearer rotation driver drives and rotates the photoconductor 40K in a rotation direction A. The charging device 60K uniformly charges a surface of the photoconductor 40K. Thereafter, the exposure device 21 depicted in FIG. 1, that is controlled according to a color image signal sent from the scanner 300 and produced based on the image data created by reading the image on the original as described above, emits writing light L that exposes the surface of the photoconductor 40K, thus forming an electrostatic latent image on the photoconductor 40K. An image processor performs image processing such as color conversion processing on the color image signal produced based on the image data created by the scanner 300. The color image signal is output to the exposure device 21 as an image signal for each of colors of yellow, magenta, cyan, and black. The exposure device 21 converts the image signal for black sent from the image processor into an optical signal. The exposure device 21 exposes the surface of the photoconductor 40K, that is uniformly charged, with the writing light L that scans the surface of the photoconductor 40K according to the optical signal, thus forming the electrostatic latent image thereon.

As illustrated in FIG. 2, the developing device 61K includes a developing roller 61Ka serving as a developer bearer that is applied with a developing bias. A developing potential is produced as an electric potential difference between the electrostatic latent image formed on the photoconductor 40K and the developing roller 61Ka. The developing potential transfers toner borne on the developing roller 61Ka to the electrostatic latent image formed on the photoconductor 40K, thus developing the electrostatic latent image into a black toner image. The developing device 61K further includes developer conveying screws 61Kb disposed on a bottom face of a developer conveying portion of the developing device 61K. A toner density sensor 312K is disposed in the bottom face of the developer conveying portion and detects the density of toner contained in a developer.

The primary transfer device 62K depicted in FIG. 1 primarily transfers the black toner image formed on the photoconductor 40K onto the intermediate transfer belt 10. After the black toner image is transferred onto the intermediate transfer belt 10, the photoconductor cleaner 63K removes residual toner remaining on the photoconductor 40K therefrom. The discharger discharges the photoconductor 40K so that the photoconductor 40K is ready for a next image forming job. Similarly, the image forming devices 18Y, 18M, and 18C include charging devices, electric potential sensors, developing devices, photoconductor cleaners, and dischargers, which surround the drum-shaped photoconductors 40Y, 40M, and 40C, respectively. Yellow, magenta, and cyan toner images are formed on the photoconductors 40Y, 40M, and 40C, respectively, and primarily transferred onto the intermediate transfer belt 10 such that the yellow, magenta, and cyan toner images are superimposed on the intermediate transfer belt 10.

In the image forming apparatus 1 having the construction described above, the exposure device 21 and the charging devices 60Y, 60M, 60C, and 60K serve as latent image formers that form electrostatic latent images on surfaces of the photoconductors 40Y, 40M, 40C, and 40K, respectively. The exposure device 21, the charging devices 60Y, 60M, 60C, and 60K, and the developing devices 61Y, 61M, 61C, and 61K serve as toner image formers that form toner images on the surfaces of the photoconductors 40Y, 40M, 40C, and 40K, respectively.

The image forming apparatus 1 according to this embodiment further includes photo interrupters 71K and 72K. The photo interrupter 71K serves as a rotation position detector that detects the rotation position of the photoconductor 40K. The photo interrupter 72K serves as a rotation position detector that detects the rotation position of the developing roller 61Ka. The photo interrupters 71K and 72K optically detect the rotation positions of the photoconductor 40K and the developing roller 61Ka serving as rotators, respectively. For example, a photo interrupter (e.g., the photo interrupters 71K and 72K) includes a light emitting element and a light receiving element that are disposed opposite each other. A detected portion such as a rotation position detecting feeler disposed in a rotating portion of the rotator passes through an interval between the light emitting element and the light receiving element and blocks light. Thus, the photo interrupter detects the rotation position of the rotator. For example, a notch may be disposed at a single position on a periphery of the rotation position detecting feeler that rotates together with the photoconductor 40K. In this case, whenever the photoconductor 40K performs a single rotation, light reaches the light receiving element once. Thus, the photo interrupter detects the rotation position of the photoconductor 40K. Alternatively, devices other than the photo interrupter may be used as the rotation position detectors that detect the rotation positions of the photoconductor 40K and the developing roller 61Ka serving as rotators, respectively.

A description is provided of a construction of a comparative fixing device.

As a sheet is conveyed over a fixing rotator, an edge of the sheet may damage a surface of the fixing rotator, causing streaks on the surface of the fixing rotator and resulting in formation of a faulty toner image. To address this circumstance, a slider serving as a presser slides over the fixing rotator serving as a pressed member, reducing the streaks caused by the edge of the sheet. While the slider swings and moves in an axial direction of the fixing rotator, that is, a direction along the surface serving as a pressed face of the fixing rotator, the slider slides over the fixing rotator.

However, while the presser that presses against the pressed member moves along the pressed face of the pressed member, pressure with which the presser presses against the pressed member may deviate from a target pressure.

Figure 3:
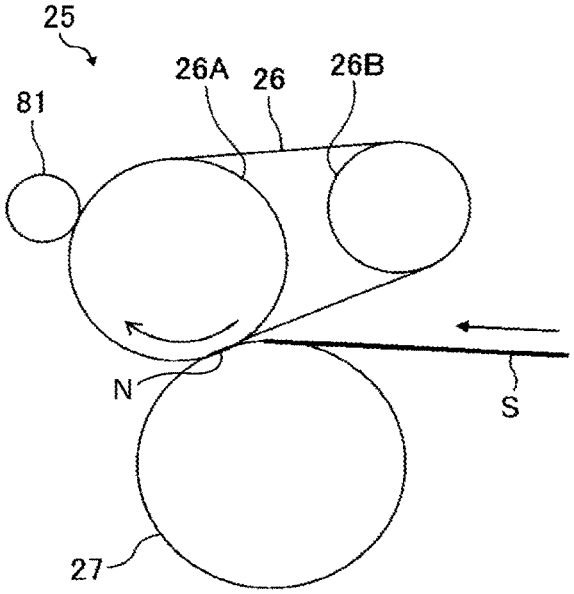
FIG. 3 is a cross-sectional view of a fixing device incorporated in the image forming apparatus depicted in FIG. 1, illustrating a construction of the fixing device.

FIG. 3 is a cross-sectional view of the fixing device 25 of the image forming apparatus 1 according to an embodiment of the present disclosure, illustrating a construction of the fixing device 25.

The fixing device 25 according to this embodiment further includes a fixing roller 26A serving as a driving rotator and a heating roller 26B serving as a driven rotator. The pressure roller 27 is pressed against the fixing belt 26 looped over the fixing roller 26A and the heating roller 26B. The fixing device 25 according to this embodiment further includes a polishing roller 81 serving as a presser or a polisher that polishes a surface (e.g., an outer circumferential surface) of the fixing belt 26 to reduce streaks and the like caused by an edge of the transfer sheet S that slides over the surface of the fixing belt 26. The polishing roller 81 presses against the fixing belt 26 serving as a pressed member.

Figure 4:
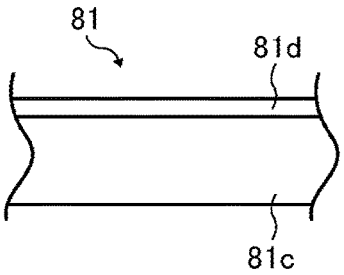
FIG. 4 is a cross-sectional view of a polishing roller incorporated in the fixing device depicted in FIG. 3.

FIG. 4 is a cross-sectional view of the polishing roller 81. As illustrated in FIG. 4, for example, the polishing roller 81 includes a metal roller 81*c* and a polishing layer 81*d* mounted on a surface of the metal roller 81*c*. The polishing layer 81*d* preferably includes an abrasive layer bound with alumina abrasive grain or the like.

Figure 5:
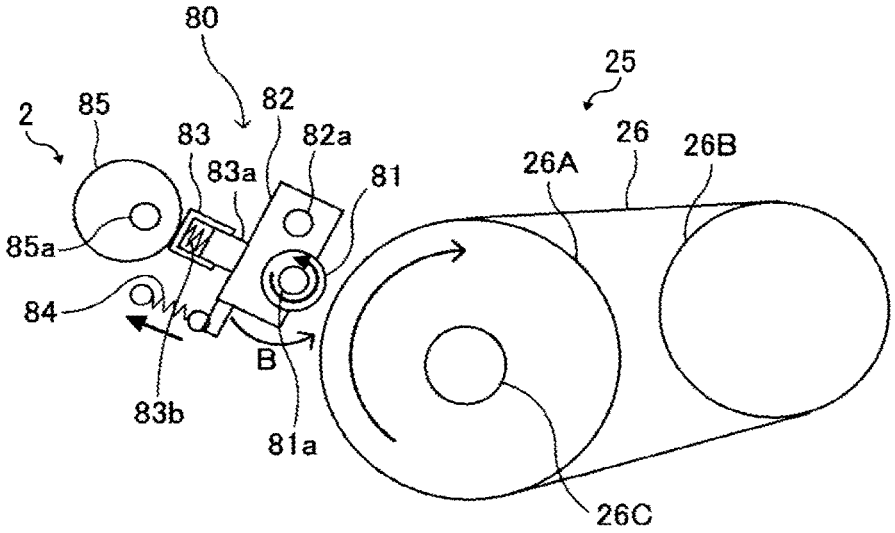
FIG. 5 is a schematic diagram of the fixing device depicted in FIG. 3, illustrating a polishing device incorporated therein and seen in an axial direction of a fixing roller shaft.

FIG. 5 is a schematic diagram of the fixing device 25, illustrating a polishing device 80 incorporated therein and seen in an axial direction of a fixing roller shaft 26C. The polishing device 80 serves as a pressure device that presses the polishing roller 81 against the fixing belt 26.

Figure 6:
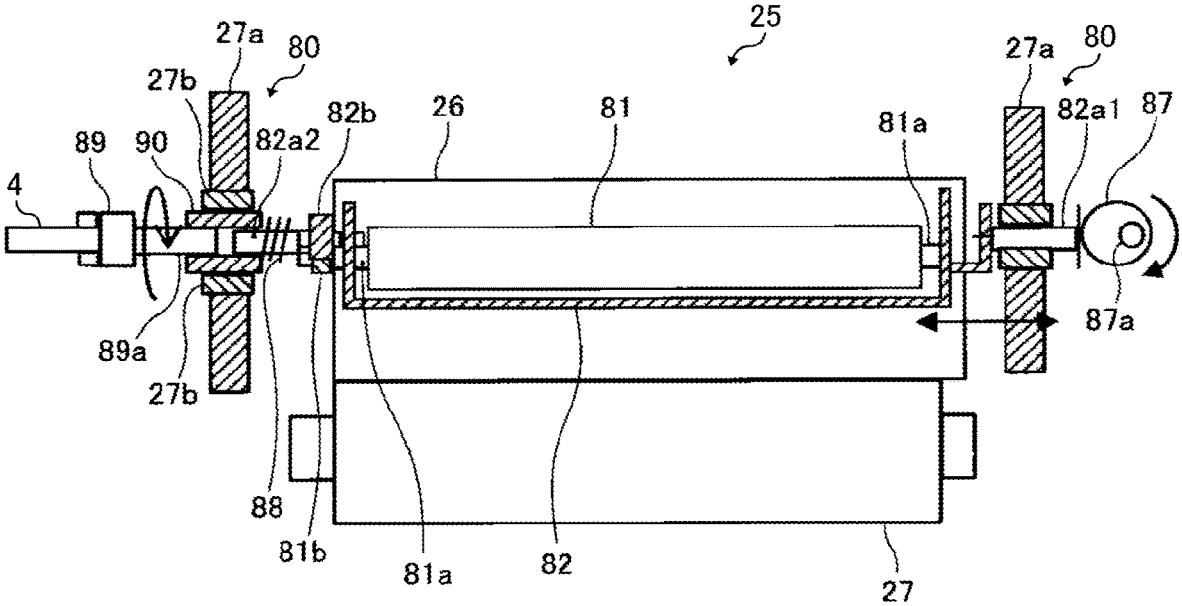
FIG. 6 is a schematic diagram of the fixing device depicted in FIG. 3, illustrating the polishing device seen in a direction perpendicular to the axial direction of the fixing roller shaft.

FIG. 6 is a schematic diagram of the fixing device 25, illustrating the polishing device 80 according to this embodiment seen in a direction perpendicular to the axial direction of the fixing roller shaft 26C.

As illustrated in FIG. 6, the fixing device 25 according to this embodiment further includes two frames 27*a* that pivotably support two support shafts 82*a* depicted in FIG. 5, that is, a first support shaft 82*a*1 and a second support shaft 82*a*2, respectively, that are mounted on a bracket 82 serving as a holder. The bracket 82 rotatably supports a rotation shaft 81*a* of the polishing roller 81. According to this embodiment, the polishing roller 81 serving as a presser is a rotator that rotates. Alternatively, the presser may be a non-rotating body that does not rotate.

In the polishing device 80 according to this embodiment, the polishing roller 81 is driven to rotate in a rotation direction opposite a rotation direction (e.g., a surface moving direction) of the fixing belt 26 such that the polishing roller 81 rotates in accordance with rotation of the fixing belt 26 at a surface moving speed higher than a surface moving speed of the fixing belt 26. Accordingly, a surface (e.g., an outer circumferential surface) of the polishing roller 81 polishes the surface (e.g., the outer circumferential surface) of the fixing belt 26, reducing streaks and the like caused by the edge of the transfer sheet S that slides over the surface of the fixing belt 26. In view of a driving load imposed on the fixing belt 26, the polishing roller 81 is preferably driven to rotate in the rotation direction opposite the rotation direction of the fixing belt 26 such that the polishing roller 81 rotates in accordance with rotation of the fixing belt 26. Alternatively, the polishing roller 81 may be driven to rotate in a rotation direction identical to the rotation direction of the fixing belt 26.

If the position of the polishing roller 81 is fixed in an axial direction thereof, irregularities on the surface of the polishing roller 81 may cause unevenness in polishing on the surface of the fixing belt 26 in an axial direction thereof, resulting in failures such as unevenness in fixing in the axial direction of the fixing belt 26 parallel to a width direction of the transfer sheet S. Additionally, a foreign substance such as offset toner and paper dust that moves and adheres to the fixing belt 26 from the transfer sheet S may move and adhere to the surface of the polishing roller 81. If the foreign substance remains being adhered to the surface of the polishing roller 81, as the polishing roller 81 polishes the fixing belt 26, the polishing roller 81 may damage the surface of the fixing belt 26, causing failures similar to the streaks caused by the edge of the transfer sheet S that slides over the fixing belt 26.

As a method for suppressing the failures effectively, the polishing roller 81 moves in the axial direction thereof in a state in which the polishing roller 81 presses against the surface of the fixing belt 26. As the polishing roller 81 moves in the axial direction thereof, the surface of the polishing roller 81 presses against the surface of the fixing belt 26 at positions on the surface of the polishing roller 81, that change. Accordingly, even if the polishing roller 81 has irregularities on the surface thereof, the polishing roller 81 suppresses unevenness in polishing on the surface of the fixing belt 26 in the axial direction thereof. Additionally, even if the foreign substance adheres to the surface of the polishing roller 81, the polishing roller 81 moves in the axial direction thereof relative to the fixing belt 26, removing the foreign substance from the polishing roller 81 and therefore eliminating the failures caused by the foreign substance.

However, the surface (e.g., a pressed face) of the fixing belt 26, that is pressed by the polishing roller 81, may be displaced by thermal expansion, rotation runout, and the like of the fixing roller 26A. Hence, displacement of the surface of the fixing belt 26 may displace the polishing roller 81 that presses against the fixing belt 26. If the polishing roller 81 displaced as described above moves in the axial direction thereof along the surface of the fixing belt 26, the polishing roller 81 moves in a direction perpendicular to a direction in which the polishing roller 81 is displaced, that is, a direction perpendicular to a pressure direction in which the polishing roller 81 presses against the fixing belt 26. Accordingly, if motivity is applied to the polishing roller 81 displaced as described above or a member that is displaced together with the polishing roller 81 to move the polishing roller 81 in the axial direction thereof, displacement of the polishing roller 81 may change the direction or the like of motivity received by the polishing roller 81. Consequently, pressure exerted to the fixing belt 26 by the polishing roller 81 may change or a turning moment (e.g., a turning moment around the rotation shaft 81*a* in a direction perpendicular to the axial direction of the polishing roller 81) may generate with respect to the polishing roller 81, varying pressure exerted by the polishing roller 81.

To address those circumstances, according to the embodiments, the polishing roller 81 pivots about the support shafts 82*a* and presses against the fixing belt 26. If the surface (e.g., the pressed face) of the fixing belt 26 is displaced, the polishing roller 81 is pivoted and displaced about the support shafts 82*a*. However, the support shafts 82*a* that support the polishing roller 81 are not displaced. To utilize this advantage, according to the embodiments, the support shafts 82*a* move in the axial direction of the polishing roller 81 to move the polishing roller 81 in the axial direction thereof in a state in which the polishing roller 81 presses against the fixing belt 26.

For example, as illustrated in FIG. 6, the support shafts 82*a* include the first support shaft 82*a*1 and the second support shaft 82*a*2. The first support shaft 82*a*1, that is, a right support shaft in FIG. 6, is pivotably supported by the frame 27*a* of the fixing device 25. A cam face of a cam 87 contacts an edge face of the first support shaft 82*a*1. As the cam 87 rotates about a cam shaft 87*a*, the cam 87 moves the first support shaft 82*a*1 in an axial direction thereof. The second support shaft 82*a*2, that is, a left support shaft in FIG. 6, is disposed opposite the first support shaft 82*a*1 contacted by the cam 87 via the polishing roller 81 in the axial direction thereof. A compression spring 88 is disposed on the second support shaft 82*a*2 and is interposed between the frame 27*a* and the bracket 82. The compression spring 88 generates a biasing force that constantly biases the bracket 82 rightward in FIG. 6, retaining contact of the edge face of the first support shaft 82*a*1 with the cam face of the cam 87. Accordingly, as the cam 87 rotates, the first support shaft 82*a*1 moves reciprocally in the axial direction thereof in accordance with rotation of the cam 87. Consequently, the bracket 82 mounting the first support shaft 82*a*1 also moves reciprocally in the axial direction of the first support shaft 82*a*1, causing the polishing roller 81 held by the bracket 82 to move reciprocally in the axial direction of the polishing roller 81 also.

According to the embodiments, even if the polishing roller 81 is pivoted and displaced about the support shafts 82*a* in accordance with displacement of the surface of the fixing belt 26, the direction of motivity applied to the first support shaft 82*a*1 (e.g., pressure that the first support shaft 82*a*1 contacting the cam face of the cam 87 receives from the cam face of the cam 87) does not change. Accordingly, the fixing device 25 suppresses change in pressure with which the polishing roller 81 presses against the fixing belt 26, generation of the turning moment with respect to the polishing roller 81, and variation in pressure exerted by the polishing roller 81 to the fixing belt 26. Thus, the fixing device 25 suppresses deviation in pressure with which the polishing roller 81 presses against the fixing belt 26 from a target pressure.

A test was performed with a configuration in which motivity was applied to the bracket 82 that supported the polishing roller 81 at a position shifted from the support shaft 82*a* and the bracket 82 moved in an axial direction of the support shaft 82*a*. However, the turning moment generated to the bracket 82, for example, and motivity applied to the bracket 82 also affected the pressure direction of the polishing roller 81, causing it difficult to press the polishing roller 81 against the fixing belt 26 with uniform pressure throughout the entire span of the polishing roller 81 in the axial direction thereof.

While the image forming apparatus 1 performs image formation, that is, while the fixing device 25 performs fixing, offset toner moves from the transfer sheet S onto the surface of the fixing belt 26 successively and remains on the surface of the fixing belt 26. Accordingly, in order to prevent the offset toner from adhering to the polishing roller 81 in a substantial amount, the polishing roller 81 preferably separates from the fixing belt 26. Hence, according to the embodiments, the polishing roller 81 pivots about the support shafts 82*a*, thus achieving a contact-separation mechanism as a separator 2 depicted in FIG. 5 that brings the polishing roller 81 into contact with the fixing belt 26 and separates the polishing roller 81 from the fixing belt 26.

As illustrated in FIG. 5, the separator 2 serving as the contact-separation mechanism according to this embodiment includes a contact-separation cam 85, a pressurization assembly 83, and a spring 84. The pressurization assembly 83 is interposed between the contact-separation cam 85 and the bracket 82. The spring 84 biases the bracket 82 to pivot about the support shaft 82*a* toward the pressurization assembly 83. FIG. 5 illustrates a separation state in which the polishing roller 81 separates from the fixing belt 26. As the contact-separation cam 85 rotates about a cam shaft 85*a* from the separation state so as to press the pressurization assembly 83 against the bracket 82, the bracket 82 pressed by the pressurization assembly 83 pivots about the support shaft 82*a* in a direction B, bringing the polishing roller 81 supported by the bracket 82 into contact with the fixing belt 26 in a contact state. Conversely, as the contact-separation cam 85 rotates from the contact state, a biasing force generated by the spring 84 pivots the pressurization assembly 83 and the bracket 82 about the support shaft 82*a* in a state in which the pressurization assembly 83 contacts and follows a cam face of the contact-separation cam 85. Accordingly, the polishing roller 81 held by the bracket 82 separates from the fixing belt 26.

In the contact state in which the polishing roller 81 contacts the fixing belt 26, a biasing force generated by a spring 83*b* of the pressurization assembly 83 biases the bracket 82 toward the fixing belt 26 through a pressure portion 83*a*. Hence, the polishing roller 81 held by the bracket 82 presses against the fixing belt 26 with a desired pressure corresponding to the biasing force generated by the spring 83*b* of the pressurization assembly 83. When the surface of the fixing belt 26 is displaced by thermal expansion, rotation runout, and the like of the fixing roller 26A, the spring 83*b* of the pressurization assembly 83 expands and contracts, allowing the polishing roller 81 to be pivoted or displaced about the support shaft 82*a* in accordance with displacement of the surface of the fixing belt 26.

Figure 7:
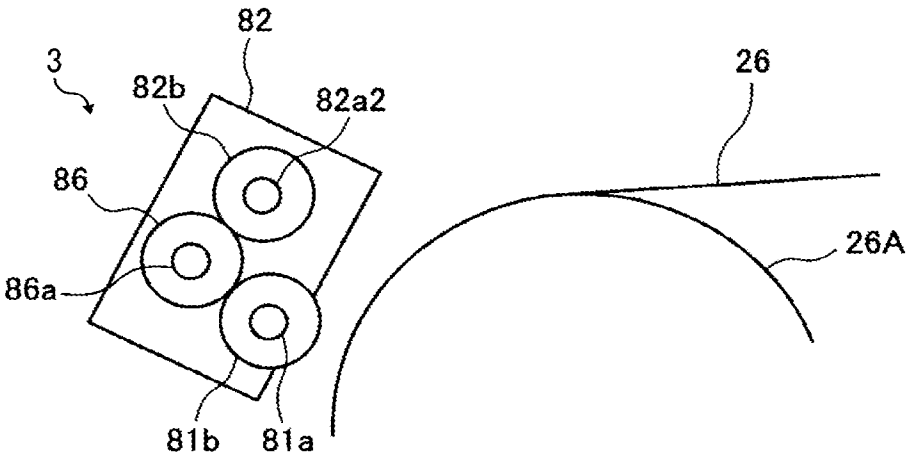
FIG. 7 is a diagram of a driving force transmitter incorporated in the polishing device depicted in FIG. 6.

FIG. 7 is a diagram of a driving force transmitter 3 as a driving force transmission mechanism that transmits a rotation driving force that drives and rotates the polishing roller 81 according to an embodiment.

The driving force transmitter 3 according to this embodiment includes a driving gear 82*b*, a driven gear 81*b*, and an idler gear 86. The driving gear 82*b* serves as a driving transmitting rotator disposed coaxially with the support shaft 82*a* (e.g., the second support shaft 82*a*2). The driven gear 81*b* serves as a driven transmitting rotator disposed on the rotation shaft 81*a* of the polishing roller 81. The driving gear 82*b* is interlocked with the driven gear 81*b* through the idler gear 86, transmitting a rotation driving force input to the driving gear 82*b* to the polishing roller 81 through the idler gear 86 and the driven gear 81*b*.

The driving gear 82*b*, the idler gear 86, and the driven gear 81*b* of the driving force transmitter 3 according to this embodiment are rotatably supported by the bracket 82 such that the driving gear 82*b*, the idler gear 86, and the driven gear 81*b* rotate about the second support shaft 82*a*2, a rotation shaft 86*a*, and the rotation shaft 81*a*, respectively. Hence, when the cam 87 depicted in FIG. 6 moves the first support shaft 82*a*1 mounted on the bracket 82 in the axial direction of the first support shaft 82*a*1, the driving gear 82*b*, the idler gear 86, and the driven gear 81*b* move together with the bracket 82 in the axial direction of the first support shaft 82*a*1. Accordingly, even if the cam 87 moves the first support shaft 82*a*1 mounted on the bracket 82 in the axial direction of the first support shaft 82*a*1, meshing between the driving gear 82*b*, the idler gear 86, and the driven gear 81*b* does not change, transmitting the rotation driving force stably.

As illustrated in FIG. 6, the driving force transmitter 3 according to this embodiment further includes a coupling 89 coaxially coupled with a driving force output shaft 4 to which a rotation driving force generated by a fixing motor serving as a driver disposed in the apparatus body 100 (e.g., the printer section) of the image forming apparatus 1 depicted in FIG. 1 is output. A coupler 90 couples a shaft 89*a*, serving as a coupling shaft mounted on the coupling 89, with the second support shaft 82*a*2 mounting the driving gear 82*b*. Accordingly, as a rotation driving force generated by the driving force output shaft 4 drives the shaft 89*a* of the coupling 89, the coupler 90 and the second support shaft 82*a*2 are also driven and rotated with the shaft 89*a*, transmitting the rotation driving force to the driving gear 82*b*. A bearing 27*b* mounted on the frame 27*a* rotatably supports the coupler 90.

When the cam 87 moves the first support shaft 82*a*1 mounted on the bracket 82 in the axial direction of the first support shaft 82*a*1, the second support shaft 82*a*2, that is mounted with the driving gear 82*b* and is supported by the bracket 82, also moves in an axial direction of the second support shaft 82*a*2 in accordance with motion of the first support shaft 82*a*1. Hence, the coupler 90 according to this embodiment couples the shaft 89*a* of the coupling 89 coupled with the driving force output shaft 4 with the second support shaft 82*a*2 in a state in which the second support shaft 82*a*2 mounting the driving gear 82*b* moves in the axial direction of the second support shaft 82*a*2. The coupler 90 is a slide bearing produced by oil-impregnated copper-based sintering or the like. For example, the second support shaft 82*a*2 is cut to have a D-shaped cross section. A hole of the coupler 90 into which the second support shaft 82*a*2 is inserted has a shape that fits the D-shaped cross section of the second support shaft 82*a*2. Thus, while the second support shaft 82*a*2 slides over the coupler 90 in the axial direction of the second support shaft 82*a*2, the second support shaft 82*a*2 rotates together with the coupler 90 that rotates.

According to this embodiment, as a rotation driving force that rotates the cam 87, for example, a driving force that rotates the fixing belt 26, that is, a rotation driving force that rotates the fixing roller 26A, is preferably used to reduce costs and save space. For example, a construction in which the fixing roller shaft 26C of the fixing roller 26A mounts a driving gear that is directly or indirectly coupled with a driven gear mounted on the cam shaft 87*a* of the cam 87 is employed. Thus, the fixing belt 26 is interlocked with the cam 87 to move the first support shaft 82*a*1 in the axial direction thereof with the driving force that moves (e.g., rotates) the fixing belt 26. Generally, the polishing roller 81 moves reciprocally in the axial direction thereof while the fixing belt 26 is driven. Hence, the construction described above is preferably employed.

The above describes the pressure device according to the embodiments of the present disclosure that is applied to the polishing device 80 including the polishing roller 81 that presses against the surface of the fixing belt 26 of the fixing device 25 of the image forming apparatus 1 as one example. Alternatively, the pressure device according to the embodiments of the present disclosure is applicable to devices other than the polishing device 80. The pressure device is applicable to devices that achieve advantages of motion of the presser, that presses against the pressed member, in an axial direction of the presser. For example, the pressure device is applicable to devices and apparatuses other than the image forming apparatus 1.

The above describes one example of the technology of the present disclosure. The technology of the present disclosure achieves advantages peculiar to aspects described below.

A description is provided of a first aspect of the technology of the present disclosure.

As illustrated in FIG. 6, a pressure device (e.g., the polishing device 80) according to the first aspect includes a presser (e.g., the polishing roller 81), a support shaft (e.g., the first support shaft 82*a*1 and the second support shaft 82*a*2), and a mover (e.g., the cam 87).

The presser presses against a pressed member (e.g., the fixing belt 26). The support shaft pivotably supports the presser. The presser pivots about the support shaft and presses against the pressed member. The mover moves the support shaft in an axial direction thereof to move the presser in the axial direction of the support shaft in a state in which the presser presses against the pressed member.

Generally, in a comparative pressure device in which a presser presses against a pressed member, thermal expansion of the pressed member, rotation runout that occurs if the pressed member is a rotator, and the like may displace a pressed face of the pressed member, causing displacement of the presser. If the presser that may be displaced as described above moves along the pressed face of the pressed member, the presser moves in a direction perpendicular to a direction in which the presser is displaced. Hence, if motivity is applied to the presser that may be displaced as described above or a member that may be displaced together with the presser or by interlocking with the presser, so as to move the presser along the pressed face of the pressed member, displacement of the presser may change the direction and the like of motivity received by the presser. Accordingly, pressure with which the presser presses against the pressed member may change or a turning moment may generate with respect to the presser, varying pressure exerted by the presser to the pressed member.

To address this circumstance, according to the first aspect, the support shaft pivotably supports the presser. The presser pivots about the support shaft so that the presser presses against the pressed member. When a pressed face of the pressed member is displaced, the presser is pivoted and displaced about the support shaft. However, the support shaft that supports the presser is not displaced. According to the first aspect, the support shaft, that is not displaced even when the presser is pivoted and displaced, moves in the axial direction of the support shaft. Accordingly, the presser that presses against the pressed member moves in the axial direction of the support shaft, that is, a direction along the pressed face of the pressed member. Hence, even if the presser is pivoted and displaced, the direction or the like of motivity received by the support shaft, that is, motivity that moves the presser in the axial direction of the support shaft, does not change, suppressing change in pressure with which the presser presses against the pressed member and generation of a turning moment with respect to the presser, that may vary pressure exerted by the presser to the pressed member. Consequently, when the presser that presses against the pressed member moves in the axial direction of the support shaft along the pressed face of the pressed member, the mover prevents pressure with which the presser presses against the pressed member from deviating from a target pressure.

A description is provided of a second aspect of the technology of the present disclosure.

As illustrated in FIG. 5, the pressure device according to the second aspect based on the first aspect further includes a holder (e.g., the bracket 82) that mounts the support shaft that is pivotably supported by a device body (e.g., the frame 27*a*) of a fixing device (e.g., the fixing device 25). The presser is a rotator (e.g., the polishing roller 81) rotatably supported by the holder.

Accordingly, with a configuration in which the rotator presses against the pressed member, the rotator moves in the axial direction of the support shaft along the pressed face of the pressed member without deviation of pressure with which the rotator presses against the pressed member from the target pressure.

A description is provided of a third aspect of the technology of the present disclosure.

As illustrated in FIG. 7, the pressure device according to the third aspect based on the second aspect further includes a driving force transmitter (e.g., the driving force transmitter 3) as a driving force transmitting mechanism that transmits a rotation driving force to the rotator. Accordingly, with a configuration in which the rotator that is driven and rotated presses against the pressed member, the rotator moves in the axial direction of the support shaft along the pressed face of the pressed member without deviation of pressure with which the rotator presses against the pressed member from the target pressure.

A description is provided of a fourth aspect of the technology of the present disclosure.

As illustrated in FIG. 7, in the pressure device according to the fourth aspect based on the third aspect, the driving force transmitter includes a driving transmitting rotator (e.g., the driving gear 82*b*) and a driven transmitting rotator (e.g., the driven gear 81*b*). The driving transmitting rotator is disposed coaxially with the support shaft. The driven transmitting rotator is mounted on a rotation shaft (e.g., the rotation shaft 81*a*) mounted on the rotator. The driving transmitting rotator is interlocked with the driven transmitting rotator. Thus, a rotation driving force that is input is transmitted from the driving transmitting rotator to the rotator through the driven transmitting rotator. The driving transmitting rotator and the driven transmitting rotator move in the axial direction of the support shaft together with the holder.

Accordingly, even if the holder moves in the axial direction of the support shaft when the rotator serving as the presser moves in the axial direction of the support shaft, the driving force is transmitted stably without affecting interlocking between the driving transmitting rotator and the driven transmitting rotator.

A description is provided of a fifth aspect of the technology of the present disclosure.

As illustrated in FIG. 6, in the pressure device according to the fifth aspect based on the fourth aspect, the driving force transmitter further includes a coupler (e.g., the coupler 90) that couples a driving force output shaft (e.g., the driving force output shaft 4) with the driving transmitting rotator. The driving force output shaft is disposed in an apparatus body (e.g., the apparatus body 100) of an image forming apparatus (e.g., the image forming apparatus 1) in a state in which the driving transmitting rotator moves in the axial direction of the support shaft.

Accordingly, even if the driving transmitting rotator moves in the axial direction of the support shaft together with the holder when the rotator serving as the presser moves in the axial direction of the support shaft, a driving force is transmitted from the driving force output shaft to the driving transmitting rotator with a simple structure.

A description is provided of a sixth aspect of the technology of the present disclosure.

As illustrated in FIG. 6, in the pressure device according to the sixth aspect based on any one of the first to fifth aspects, the mover moves the support shaft in the axial direction thereof with a driving force that moves the pressed member.

Accordingly, compared to a configuration in which a driver that moves the support shaft in the axial direction thereof is provided separately from a driver that moves the pressed member, the pressure device has a simple structure, saving space.

A description is provided of a seventh aspect of the technology of the present disclosure.

As illustrated in FIG. 6, in the pressure device according to the seventh aspect based on any one of the first to sixth aspects, the mover moves the presser reciprocally in the axial direction of the support shaft.

Accordingly, with a configuration in which the mover moves the presser reciprocally in the axial direction of the support shaft, the mover moves the presser in the axial direction of the support shaft along the pressed face of the pressed member without deviation of pressure with which the presser presses against the pressed member from the target pressure.

A description is provided of an eighth aspect of the technology of the present disclosure.

As illustrated in FIG. 6, in the pressure device according to the eighth aspect based on any one of the first to seventh aspects, the presser is a polisher (e.g., the polishing roller 81) that polishes the pressed member.

Accordingly, since the polisher moves in the axial direction of the support shaft, a surface of the polisher presses against a surface of the pressed member at positions on the surface of the polisher, that change. Consequently, even if the surface of the polisher has irregularities in the axial direction of the support shaft, the polisher suppresses unevenness in polishing on the surface of the pressed member in the axial direction of the support shaft.

A description is provided of a ninth aspect of the technology of the present disclosure.

As illustrated in FIG. 4, in the pressure device according to the ninth aspect based on the eighth aspect, the polisher includes a metal roller (e.g., the metal roller 81*c*) and a polishing layer (e.g., the polishing layer 81*d*). The polishing layer is mounted on a surface of the metal roller and includes an abrasive layer made of abrasive grain. The polisher is a roller (e.g., the polishing roller 81) that is driven and rotated by the driving force transmitter so that the polisher moves relative to the pressed member.

Accordingly, the polisher attains a simple structure that polishes the surface of the pressed member.

A description is provided of a tenth aspect of the technology of the present disclosure.

As illustrated in FIG. 5, the pressure device according to the tenth aspect based on any one of the first to ninth aspects further includes a separator (e.g., the separator 2) as a contact-separation mechanism that causes the presser to pivot about the support shaft to bring the presser into contact with the pressed member and separate the presser from the pressed member.

Accordingly, the presser comes into contact with and separates from the pressed member.

A description is provided of an eleventh aspect of the technology of the present disclosure.

As illustrated in FIG. 3, a fixing device (e.g., the fixing device 25) according to the eleventh aspect includes a fixing rotator (e.g., the fixing belt 26) and a pressure rotator (e.g., the pressure roller 27). As a recording medium (e.g., a transfer sheet S) bearing an unfixed image is conveyed through a fixing nip (e.g., the fixing nip N) formed between the fixing rotator and the pressure rotator, the fixing rotator and the pressure rotator fix the unfixed image on the recording medium. The fixing device further includes the pressure device according to any one of the first to tenth aspects that presses the presser (e.g., the polishing roller 81), that is pivotably supported by the support shaft (e.g., the support shaft 82*a*), against the fixing rotator.

Accordingly, when the presser that presses against the fixing rotator moves in the axial direction of the support shaft along a pressed face of the fixing rotator serving as the pressed member, the pressure device suppresses deviation of pressure with which the presser presses against the fixing rotator from the target pressure.

A description is provided of a twelfth aspect of the technology of the present disclosure.

As illustrated in FIG. 1, an image forming apparatus (e.g., the image forming apparatus 1) according to the twelfth aspect includes the pressure device according to any one of the first to tenth aspects or the fixing device according to the eleventh aspect.

Accordingly, when the presser that presses against the pressed member moves in the axial direction of the support shaft along the pressed face of the pressed member, the image forming apparatus prevents pressure with which the presser presses against the pressed member from deviating from the target pressure.

According to the embodiments described above, the fixing belt 26 serves as a fixing rotator. Alternatively, a fixing roller, a fixing film, a fixing sleeve, or the like may be used as a fixing rotator. Further, the pressure roller 27 serves as a pressure rotator. Alternatively, a pressure belt or the like may be used as a pressure rotator.

According to the embodiments described above, the image forming apparatus 1 is a copier. Alternatively, the image forming apparatus 1 may be a printer, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A pressure device configured to press against a pressed member, the pressure device comprising:

a first support shaft and a second support shaft having a same axial direction, the first support shaft and the second support shaft arranged at opposite ends of the pressure device along the axial direction;

a presser to pivot about the first and second support shafts, rotate about a rotation shaft, and press against the pressed member; and a mover contacting the first support shaft, the mover to move the first support shaft in the axial direction to move the presser in the axial direction toward the second support shaft, wherein the rotation shaft is between the first support shaft and the second support shaft along the axial direction.

2. The pressure device according to claim 1, further comprising a holder mounting the support shaft, wherein the presser includes a rotator rotatably supported by the holder.

3. The pressure device according to claim 2, further comprising a driving force transmitter to transmit a rotation driving force to the rotator.

4. The pressure device according to claim 3, further comprising the rotation shaft mounted on the rotator, wherein the driving force transmitter includes a driving transmitting rotator disposed coaxially with the second support shaft, and a driven transmitting rotator mounted on the rotation shaft, and the driving transmitting rotator is interlocked with the driven transmitting rotator to transmit the rotation driving force from the driving transmitting rotator to the rotator through the driven transmitting rotator.

5. The pressure device according to claim 4, wherein the driving transmitting rotator and the driven transmitting rotator both move in the axial direction of the first support shaft together with the holder.

6. The pressure device according to claim 4, wherein the driving transmitting rotator includes a driving gear, and the driven transmitting rotator includes a driven gear.

7. The pressure device according to claim 1, wherein the mover moves the presser reciprocally in the axial direction of the first support shaft.

8. The pressure device according to claim 1, further comprising a separator to cause the presser to pivot about the first and second support shafts to bring the presser into contact with the pressed member and separate the presser from the pressed member.

9. The pressure device according to claim 1, wherein the mover includes a cam in contact with the first support shaft.

10. A fixing device, comprising:

a fixing rotator;

a pressure rotator configured to press against the fixing rotator to form a fixing nip between the fixing rotator and the pressure rotator, the fixing nip through which a recording medium bearing an unfixed image is conveyed; and a pressure device configured to press against the fixing rotator, the pressure device including a first support shaft and a second support shaft having a same axial direction, the first support shaft and the second support shaft arranged at opposite ends of the pressure device along the axial direction;

a presser to pivot about the first and second support shafts, rotate about a rotation shaft, and press against the fixing rotator; and a mover contacting the first support shaft, the mover to move the first support shaft in the axial direction to move the presser in the axial direction toward the second support shaft, wherein the rotation shaft is between the first support shaft and the second support shaft along the axial direction.

11. The fixing device according to claim 10, wherein the pressure device further includes a holder mounting the support shaft.

12. The fixing device according to claim 10, further comprising a device body configured to pivotably support each of the first and second support shafts.

13. The fixing device according to claim 10, wherein the fixing rotator is interlocked with the mover to move the first support shaft in the axial direction of the first support shaft with a driving force that moves the fixing rotator.

14. The fixing device according to claim 10, wherein the presser includes a polisher to polish the fixing rotator.

15. The fixing device according to claim 14, wherein the polisher includes a polishing roller including:

a metal roller; and a polishing layer mounted on a surface of the metal roller, the polishing layer including abrasive grain.

16. The fixing device according to claim 15, wherein the polishing roller moves relative to the fixing rotator, and the pressure device further includes a driving force transmitter configured to drive and rotate the polishing roller.

17. An image forming apparatus, comprising:

an image bearer to bear an image; and a fixing device to fix the image on a recording medium, the fixing device including:

a fixing rotator;

a pressure rotator to press against the fixing rotator to form a fixing nip between the fixing rotator and the pressure rotator, the fixing nip through which a recording medium bearing an unfixed image is conveyed; and a pressure device to press against the fixing rotator, wherein the pressure device includes a first support shaft and a second support shaft having a same axial direction, the first support shaft and the second support shaft arranged at opposite ends of the pressure device along the axial direction;

a presser to pivot about the first and second support shafts, rotate about a rotation shaft, and press against the fixing rotator; and a mover contacting the first support shaft, the mover to move the first support shaft in the axial direction to move the presser in the axial direction toward the second support shaft, and the rotation shaft is between the first support shaft and the second support shaft along the axial direction.

18. The image forming apparatus according to claim 17, wherein the pressure device further includes:

the rotation shaft mounted on the presser; and a driving force transmitter including a driving transmitting rotator disposed coaxially with the second support shaft; and a driven transmitting rotator mounted on the rotation shaft, and the driving transmitting rotator is interlocked with the driven transmitting rotator to transmit a rotation driving force from the driving transmitting rotator to the presser through the driven transmitting rotator.

19. The image forming apparatus according to claim 18, further comprising:

an apparatus body; and a driving force output shaft disposed in the apparatus body, wherein the driving force transmitter further includes a coupler to couple the driving force output shaft with the driving transmitting rotator in a state in which the driving transmitting rotator is movable in the axial direction of the first support shaft.

20. The image forming apparatus according to claim 19, wherein the driving force transmitter further includes:

a coupling coaxially coupled with the driving force output shaft; and a coupling shaft mounted on the coupling, and the coupler couples the coupling shaft with the second support shaft.

* * * * *